US010184307B2

(12) United States Patent
Bar et al.

(10) Patent No.: US 10,184,307 B2
(45) Date of Patent: Jan. 22, 2019

(54) EXPANDABLE BALL SEAT FOR USE IN FRACTURING GEOLOGIC FORMATIONS

(71) Applicant: TIW Corporation, Houston, TX (US)

(72) Inventors: Ahmad Warid Abdel Bar, Missouri City, TX (US); Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 603 days.

(21) Appl. No.: 14/741,241

(22) Filed: Jun. 16, 2015

(65) Prior Publication Data

US 2016/0369582 A1 Dec. 22, 2016

(51) Int. Cl.

| | |
|---|---|
| ***E21B 23/01*** | (2006.01) |
| ***E21B 23/04*** | (2006.01) |
| ***E21B 33/12*** | (2006.01) |
| ***E21B 23/02*** | (2006.01) |
| ***E21B 43/26*** | (2006.01) |

(52) U.S. Cl.

CPC ..... *E21B 23/01* (2013.01); *E21B 23/02* (2013.01); *E21B 23/04* (2013.01); *E21B 43/26* (2013.01)

(58) Field of Classification Search

CPC ..... E21B 43/103; E21B 43/105; E21B 34/10; E21B 43/26

See application file for complete search history.

(56) References Cited

U.S. PATENT DOCUMENTS

| | | | | |
|---|---|---|---|---|
| 2007/0034386 | A1* | 2/2007 | Henry | E21B 29/10 166/387 |
| 2014/0054047 | A1* | 2/2014 | Zhou | E21B 43/106 166/382 |
| 2015/0114620 | A1* | 4/2015 | Halfmann | E21B 33/1292 166/77.51 |
| 2016/0186511 | A1* | 6/2016 | Coronado | E21B 33/128 166/381 |

* cited by examiner

*Primary Examiner* — D. Andrews
*Assistant Examiner* — Brandon M Duck
(74) *Attorney, Agent, or Firm* — Baker Bolts L.L.P.

(57) ABSTRACT

A ball seat is expanded and held in place within a casing using an expander. The ball seat includes one or more gripping elements and one or more sealing elements. An apparatus for expandably installing a ball seat in a casing includes a ball seat having one or more gripping elements and one or more elastomeric sealing elements disposed on an exterior of an expandable sleeve portion of the ball seat that is expanded by pulling an expander into the bore of the expandable sleeve portion of the ball seat. A mechanical fuse is predisposed to fail at a level of force sufficient to move the expander to the installed position. Failure of the fuse and further movement of a pulling mandrel positions a channel on the mandrel into alignment with a distal end of the collet, enabling the collet to collapse and pass through the expander for removal.

21 Claims, 12 Drawing Sheets

EXPANDABLE BALL SEAT FOR USE IN FRACTURING GEOLOGIC FORMATIONS

BACKGROUND

Field of the Invention

The present invention relates to an apparatus for expanding and installing a ball seat in a casing of a well. The installed ball seat can sealably receive a ball to isolate a portion of the casing and enable fracturing of the well. Repeated installation of the ball seat of the present invention enables the fracturing of a formation in planned stages.

Background of the Related Art

Many mineral-bearing geologic formations can be hydraulically fractured to increase production rates and recovery of hydrocarbons residing in the formation. Staged fracturing is a process by which a plurality of intervals of a formation or well can be fractured in series, resulting in optimal production and recovery.

In conventional fracturing operations, plugging device such as, for example, a bridge plug can be set in the casing. The casing is perforated and the hydraulic pressure is increased to a level sufficient to fracture the adjacent geologic zone.

Conventional plugging device present unwanted costs and difficulties. If left in the casing during production, it may present a bore restriction that limits production or obstructs subsequent well operations. If the plugged device is removed from the well prior to production, it may require a service rig or a drilling rig to run a tool into the well on a tubular string to unseat, mill and/or remove the plugging device from the well. The removal of plugging device after fracturing greatly increases the cost of the operation.

BRIEF SUMMARY

One embodiment of the present invention provides an apparatus for being run into a well casing at a distal end of an elongate positioning member for installing a large internal diameter ball seat at a targeted depth in the well casing, the apparatus comprising a tubular housing having a proximal end connected to the positioning member, a distal end and a bore, a pulling mandrel movably disposed within the bore of the housing and having a proximal end and a connector at a distal end, the pulling mandrel movable from an extended position to a retracted position relative to the housing, a motive member coupled intermediate the housing and the pulling mandrel, the motive member being activatable, through the positioning member, to move the pulling mandrel from the extended position to the retracted position, a ball seat assembly having, a bore with an inner diameter to receive the pulling mandrel, a ball seat at a proximal end, an expandable sleeve portion that includes a distal end of the ball seat assembly, one of a straight or an inwardly tapered bore at the distal end of the expandable sleeve portion, at least one circumferential sealing element disposed on a radially exterior surface of the expandable sleeve portion, and at least one gripping element disposed within a channel on the exterior surface of the expandable sleeve portion, a tubular expander having a bore, an inwardly tapered exterior portion at a proximal end engaging the one of a straight and an inwardly tapered bore at the distal end of the expandable sleeve portion of the ball seat assembly, a distal end, and an outer diameter that is larger than the inner diameter of the expandable sleeve portion of the ball seat assembly, a collet removably received within the bore of the expander and having a proximal end with a first bore, a distal end with a second bore that is radially inwardly collapsible, a radially inwardly disposed channel intermediate the first bore and the second bore, and a notch on a radially exterior portion of the collet to engage the distal end of the expander for displacing the expander towards the housing and into the bore of the ball seat assembly, a spacer having a bore to receive the pulling mandrel, a proximal end to engage the distal end of the collet, and a distal end, a mechanical fuse having a bore with an inner diameter, an outer diameter, a proximal face to engage the spacer, and a distal end, and a retainer having a bore, a proximal end with a connector connected to the connector on the distal end of the pulling member to secure the mechanical fuse between the retainer, engaging the distal face of the mechanical fuse, and the pulling mandrel, engaging the proximal face of the mechanical fuse, the retainer further including an outer diameter at the proximal end of the retainer being greater than the inner diameter of the bore of the mechanical fuse element and less than the outer diameter of the mechanical fuse element, a distal end with an outer diameter greater than the outer diameter at the proximal end of the retainer, and a radially inwardly disposed channel intermediate the proximal end and the distal end of the retainer, the channel having an axial span that is greater than an axial span of the second, collapsible bore of the collet, wherein upon activation of the motive member to move the pulling mandrel from the extended position to the retracted position, the retainer applies pressure to an inner annular distal face of the mechanical fuse element to produce a reaction force applied by the spacer engages to an outer annular proximal face of the mechanical fuse element that is radially offset from the inner annular distal face and to move the pulling mandrel, the retainer, the mechanical fuse, the spacer, the collet, engaged at the distal end by the spacer, and the expander, axially engaged by the collet at the notch on a radially exterior portion of the collet, towards the housing, to pull the expander into the bore of the expandable sleeve portion of the ball seat assembly, wherein upon application by the spacer of a reaction force against the outer annular proximal face of the mechanical fuse of pressure sufficient to shear the mechanical fuse along a shear face intermediate the outer annular proximal face and the inner annular distal face of the mechanical fuse, the mechanical fuse sacrificially fails along the shear face to separate a sheared portion of the mechanical fuse from a remaining portion of the mechanical fuse, wherein after failure of the mechanical fuse, the pulling mandrel, the retainer and the remaining portion of the mechanical fuse move by the activated motive member through an interval towards the retracted position of the pulling mandrel engages the proximal end of the collet with a stop well on the pulling mandrel to prevent further movement of the pulling mandrel without movement of the collet, and also disposes the distal end of the collet radially adjacent to the channel of the retainer, wherein further movement of the pulling mandrel, the retainer and the remaining portion of the mechanical fuse by the activated motive member towards the retracted position of the pulling mandrel towards the retracted position of the pulling, mandrel collapses the second bore at the distal end of the collet into the channel of the retainer to enable the collet to move with the pulling mandrel from the bore of the expander, leaving the expander in an interference fit with the well casing with the expanded sleeve portion of the ball seat assembly sandwiched therebetween and with the ball seat of the ball seat assembly positioned adjacent to the expander and expanded sleeve portion of the ball seat assembly to receive and seal with a ball, wherein the positioning member is used to remove the apparatus, less the expander and the ball seat assembly, from the casing. An embodiment of the apparatus may include as a gripping element of the ball seat assembly at least one slip member having gripping teeth on a radially outwardly disposed surface, the at least one gripping element being slidably received into an open end of the at least one dovetail groove formed on an exterior surface of the sleeve portion of the ball seat assembly, and wherein the at least one groove extends along a portion of the exterior surface of the sleeve portion of the ball seat assembly and perpendicularly to an axis of the sleeve portion. An embodiment of the apparatus may include a circumferential sealing element of the ball seat assembly having a radially outwardly extending circumferential ridge. An embodiment of the apparatus may include a circumferential sealing element of the ball seat assembly having a plurality of radially outwardly extending circumferential ridges, each axially spaced from the others. An embodiment of the apparatus may include a circumferential sealing element of the ball seat having at least one deformable elastomeric sealing element with an original thickness and width, the at least one elastomeric sealing element circumferentially disposed on the exterior surface of the expandable sleeve portion of the ball seat assembly and intermediate a first radially outwardly extending circumferential ridge and a second radially outwardly extending circumferential ridge.

An embodiment of the apparatus of the present invention may be positioned within the well casing using an elongate positioning member such as a tubular string including a plurality of pipe segments connected in series and a distal end connected to the apparatus, and wherein the motive member is a hydraulically powered displacement device responsive to a predetermined hydraulic pressure provided to the apparatus through a bore of the tubular string. An embodiment of the apparatus of the present invention may be positioned within the well casing using an elongate positioning member such as a wireline including an electrically conductive cable, wherein the motive member includes an electrically powered pump provided to pump liquid into a hydraulically powered displacement device. An embodiment of the apparatus of the present invention may be positioned within the well casing using an elongate positioning member is a coiled tubing unit.

The sacrificially failing mechanical fuse of the apparatus of the present invention may comprise a metal member having a circular groove therein and a metal member having a plurality of holes equi-angularly distributed therein.

In one embodiment of the apparatus of the present invention, the connector at the distal end of the pulling mandrel and the connector at the proximal end of the retainer are threaded connectors.

In one embodiment of the apparatus of the present invention, the pulling mandrel and the retainer together comprise a central bore through which fluid may pass as the apparatus is run into the well casing to a targeted interval.

In one embodiment of the apparatus of the present invention, the sheared portion of the mechanical fuse and the spacer are retained on an enlarged distal portion of the retainer for removal from the well casing.

The following is a brief description of the several views of the drawings that are appended hereto. It should be understood that the drawings illustrate one or more embodiments of the apparatus of the present invention, and do not limit the scope of the invention, which is limited only by the claims.

DETAILED DESCRIPTION

Figure 1:
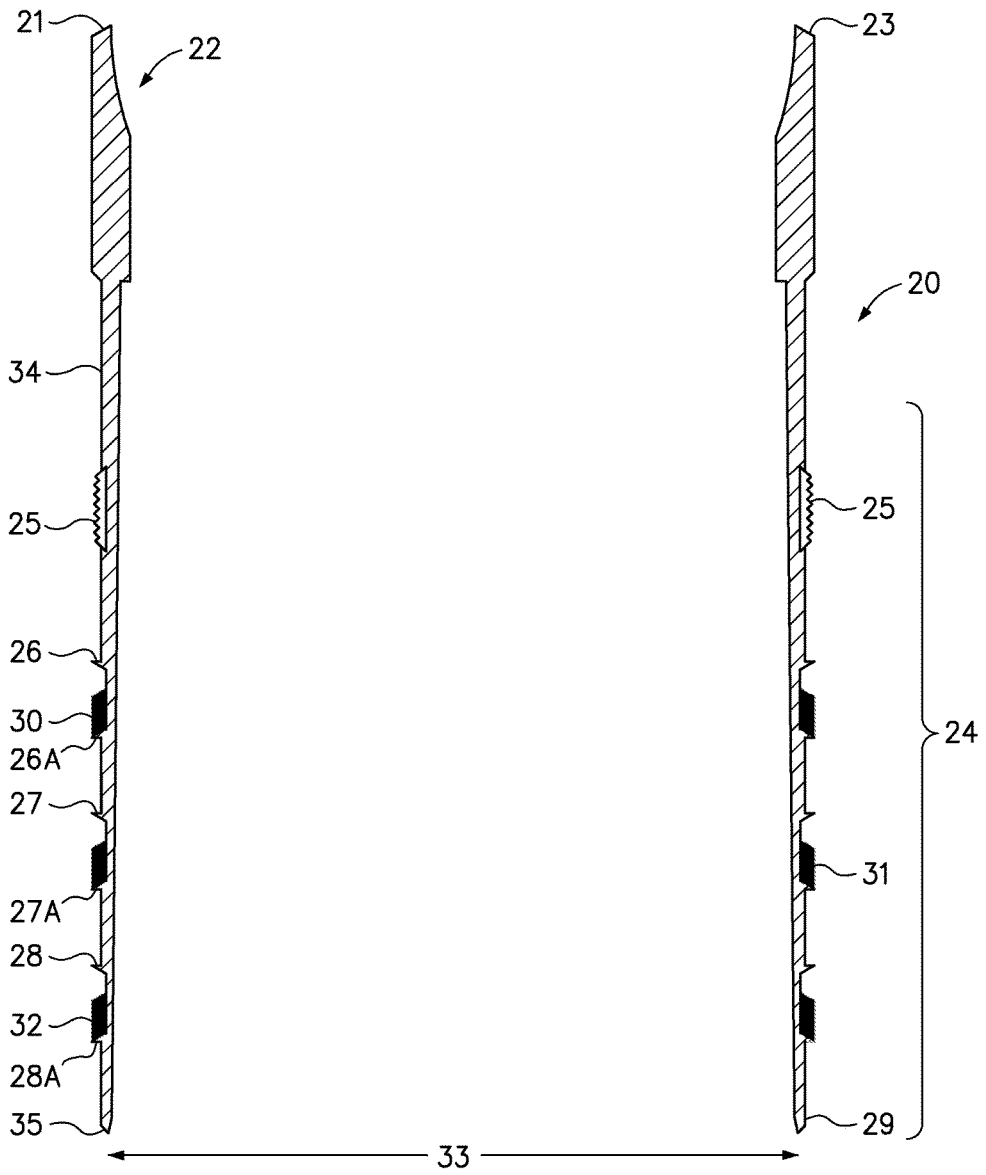
FIG. 1 is an elevation view of an expandable sleeve having a ball seat at a proximal end, a bore, a distal end, at least one gripping element and a plurality of sealing elements on an exterior surface.

FIG. 1 is an elevation view of an expandable ball seat 20 having a ball seat 22 at a proximal end 21, an optional inwardly tapered bore portion 35 at a distal end 29, and a plurality of sealing elements 26, 26A, 27, 27A, 28, 28A, 30, 31 and 32 on an exterior surface 34 of an expandable sleeve portion 24 of the expandable ball seat 20. Some of the sealing elements disposed on the expandable sleeve portion 24 of FIG. 1 are radially outwardly directed protrusions 26, 26A, 27, 27A, 28 and 28A that may be integrally formed on the exterior surface 34 of the expandable ball seat 20 to penetratively engage an interior wall 87 of the casing 88 (not shown in FIG. 1) in which a ball seat is to be installed. These protrusions 26, 26A, 27, 27A, 28 and 28A may partially deform upon forcible engagement with an interior wall 87 of the well casing 88, as will be discussed below in connection with FIGS. 8 and 9. Other sealing elements disposed on the expandable sleeve portion 24 of the expandable ball seat 20 may include elastomeric sealing elements 30, 31 and 32. An elastomeric sealing element 30 and/or 31 may each be disposed intermediate two spaced-apart penetrative protrusions 26, 27 and 28 and sized to elastomerically deform and engage the protrusions 26, 27 or 28 that straddle an elastomeric sealing element 30 and/or 31. The expandable ball seat 20 of FIG. 1 has a bore with an inner diameter 33 and an optional dog or protrusion 23 at the proximal end 21 to engage a corresponding notch or groove on a reaction member 58 not shown in FIG. 11 as discussed in more detail below. The exterior surface 34 of the expandable ball seat 20 of FIG. 1 further includes at least one gripping element 25 such as, for example, a slip.

Figure 1A:
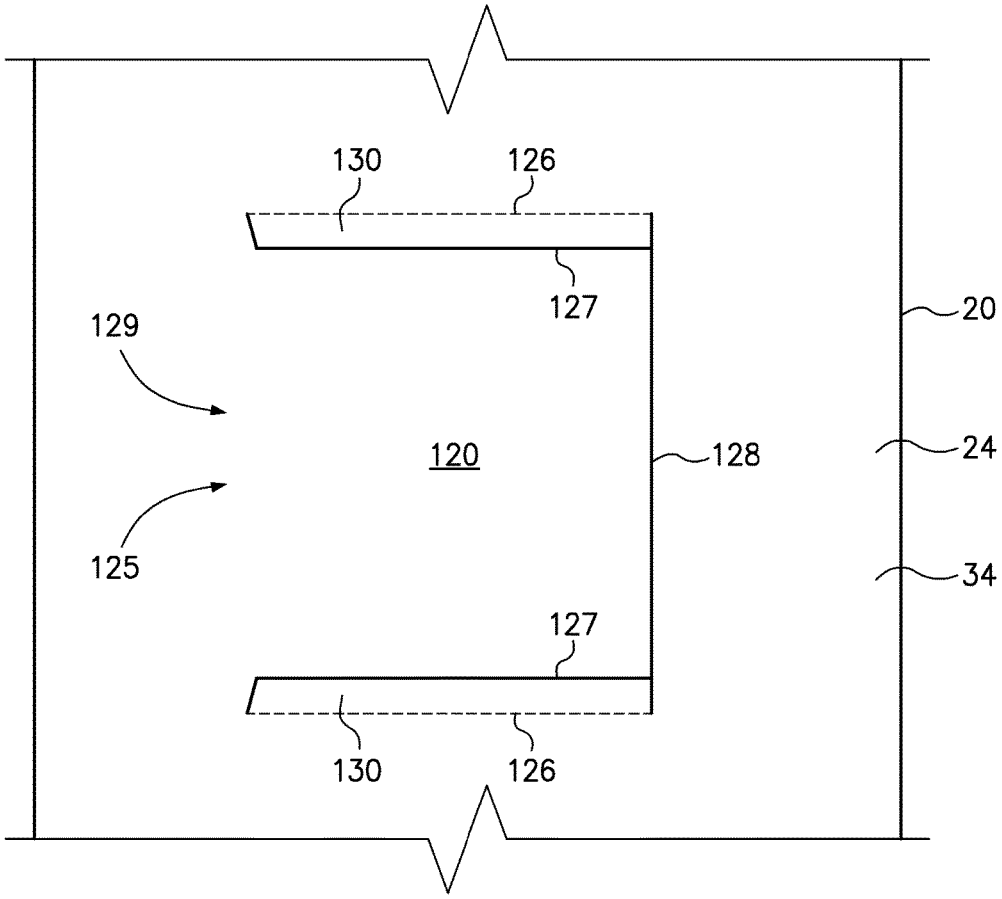
FIG. 1A is an enlarged elevation view of a dovetail groove in the expandable sleeve portion of the expandable ball seat that retains the at least one gripping element shown in FIG. 1.

FIG. 1A is an enlarged elevation view of a dovetail groove 120 in the expandable sleeve portion 24 of the expandable ball seat 20 that retains the at least one gripping element 25 shown in FIG. 1. The dovetail groove 120, surrounded by the exterior surface 34 of the expandable sleeve portion 24 of the expandable ball seat 20, includes a pair of angled recesses 130, a stop wall 128 and an open end 129 through which a gripping element 25 can be received into the dovetail groove 120. Each of the angled recesses 130 extend to an edge 126 that is underneath the overhangs 127 that engage and retain the tapered edges 132 of the at least one gripping element 25 received into the dovetail groove 120.

Figure 1B:
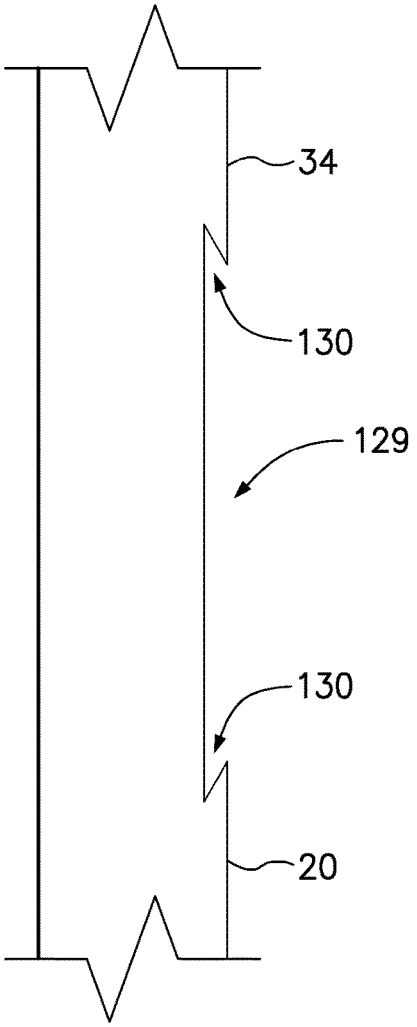
FIG. 1B is a side elevation view of the dovetail groove of FIG. 1A illustrating the recesses that receive and secure the at least one gripping element within the expandable sleeve portion of the expandable ball seat.

FIG. 1B is a side elevation view of the dovetail groove 120 of FIG. 1A as viewed from the open end 129 through which a gripping element 25 is received into the dovetail groove 120. FIG. 1B illustrates the pair of recesses 130 that receive and secure the tapered edges 132 of the at least one gripping element 25 within the expandable sleeve portion 24 of the expandable ball seat 20.

Figure 1C:
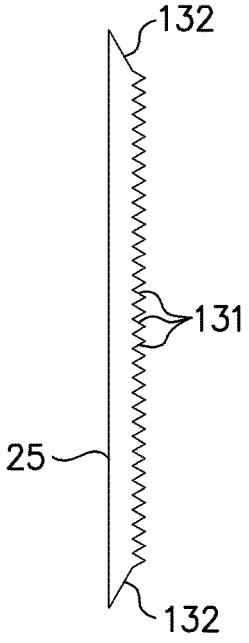
FIG. 1C is a side elevation view of the at least one gripping element having a plurality of gripping teeth for engaging an interior wall of a casing.

FIG. 1C is a side elevation view of the at least one gripping element 25 having a pair of tapered edges 132 for being received into the pair of recesses 130 of the dovetail groove 120 and a plurality of gripping teeth 131 therebetween for engaging an interior wall 87 of a casing 88.

Figure 2:
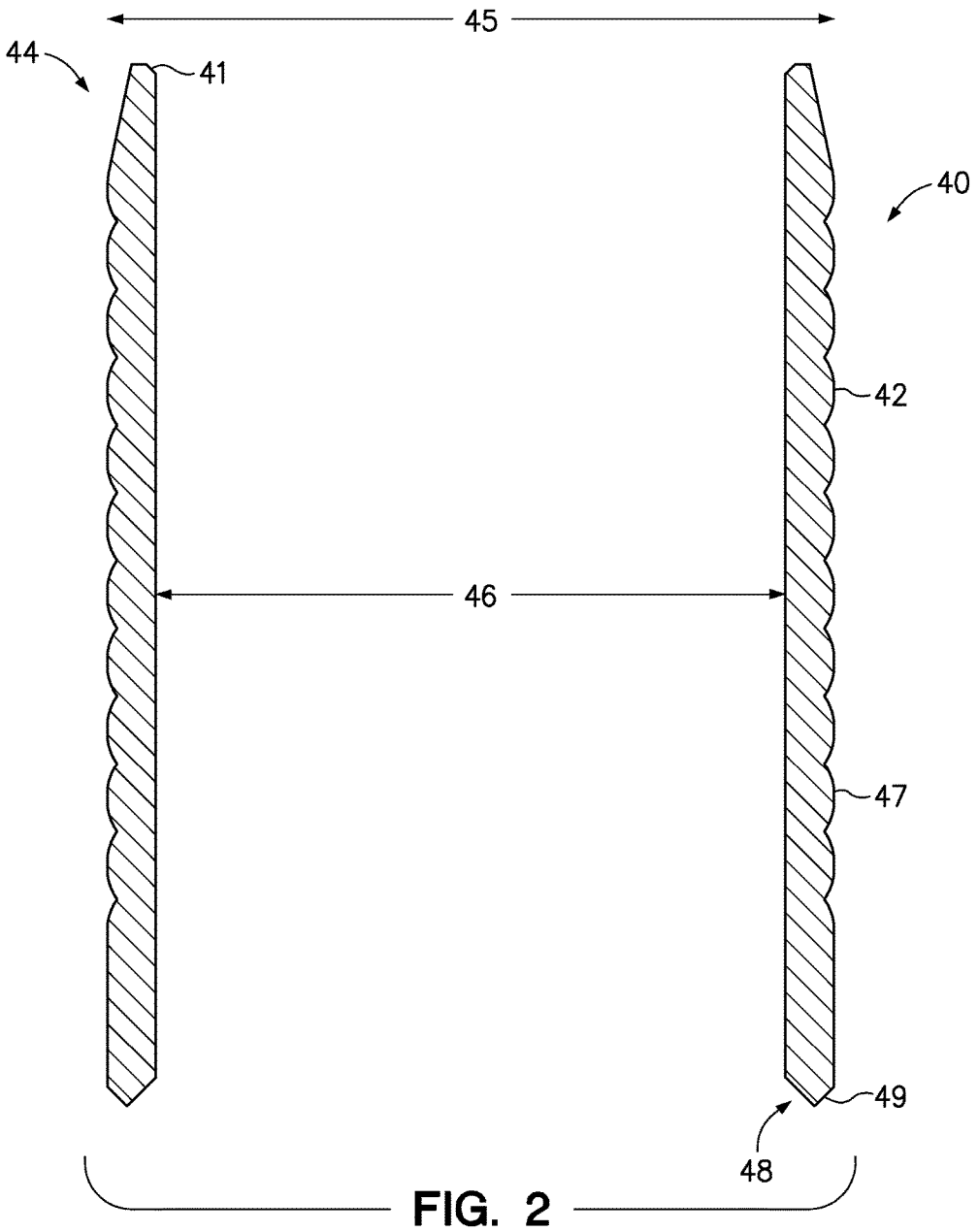
FIG. 2 is an elevation view of a tubular expander having an inwardly tapered portion on the exterior surface and at the proximal end to engage and expand the one of a straight and an inwardly tapered bore at the distal end of the expandable sleeve.

FIG. 2 is an elevation view of a tubular expander 40 having an inwardly tapered portion 44 at the proximal end 41 of the exterior surface 42 for engaging an optional inwardly tapered bore portion 35 at the distal end 29 of the expandable ball seat 20. The tubular expander 40 includes a distal end 49 having an inwardly tapered bore portion 44 on the exterior surface 42. The expander 40 has an outer diameter 45 and an inner diameter 46. The outer diameter 45 is larger than the inner diameter 33 of the expandable hall seat 20. Optionally, the expander 40 may include a plurality of scallops 47 along the exterior surface 42.

Figure 3:
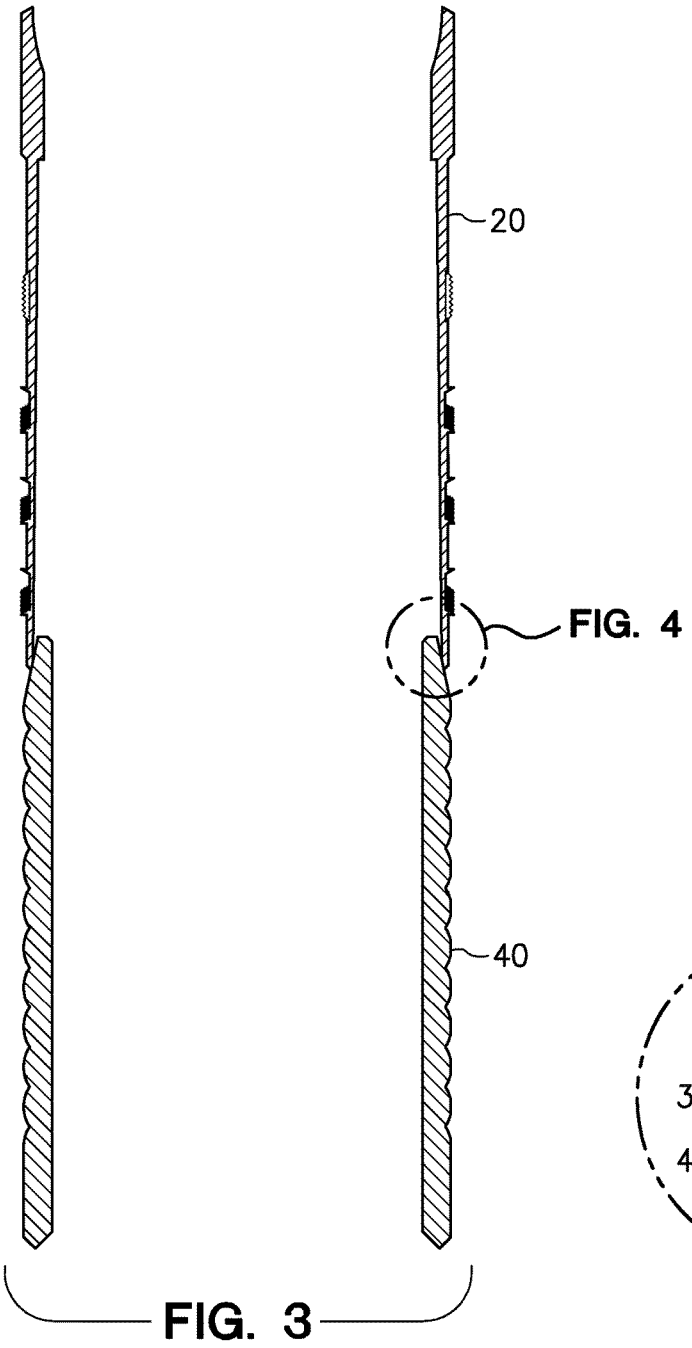
FIG. 3 is an elevation view of the expandable sleeve with the ball seat of FIG. 1 and the expander of FIG. 2 disposed one engaged with the other in a run-in configuration in which these components are captured on the apparatus of the present invention.

FIG. 3 is an elevation view of the expandable ball seat 20 of FIG. 1 and the expander 40 of FIG. 2 disposed in a run-in configuration one relative to the other. The inwardly tapered portion 44 at the proximal end 41 of the exterior surface 42 of the expander 40 is received into the (optional) inwardly tapered bore portion 35 at the distal end 29 of the expandable ball seat 20 in the run-in configuration of the apparatus 10 (not shown in FIG. 3) of the present invention. It will be understood that the components shown in FIG. 3, the expandable ball seat 20 and the expander 40, must be restrained in the run-in configuration illustrated in FIG. 3 by other components of the apparatus 10.

Figure 4:
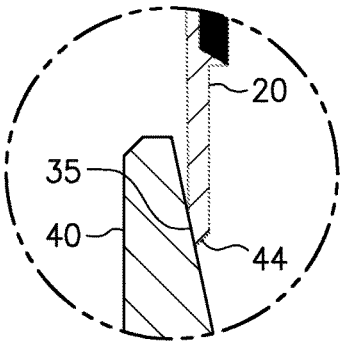
FIG. 4 is an enlarged view of the inwardly tapered portion of the exterior surface of the expander received into the bore at the distal end of the expandable sleeve in the run-in configuration illustrated in FIG. 3.

FIG. 4 is an enlarged view of the inwardly tapered portion 44 of the exterior surface 42 of the expander 40 received into the one of a straight and an inwardly tapered bore portion 35 at the distal end 29 of the expandable ball seat 20 in the run-in configuration illustrated in FIG. 3.

Figure 5:
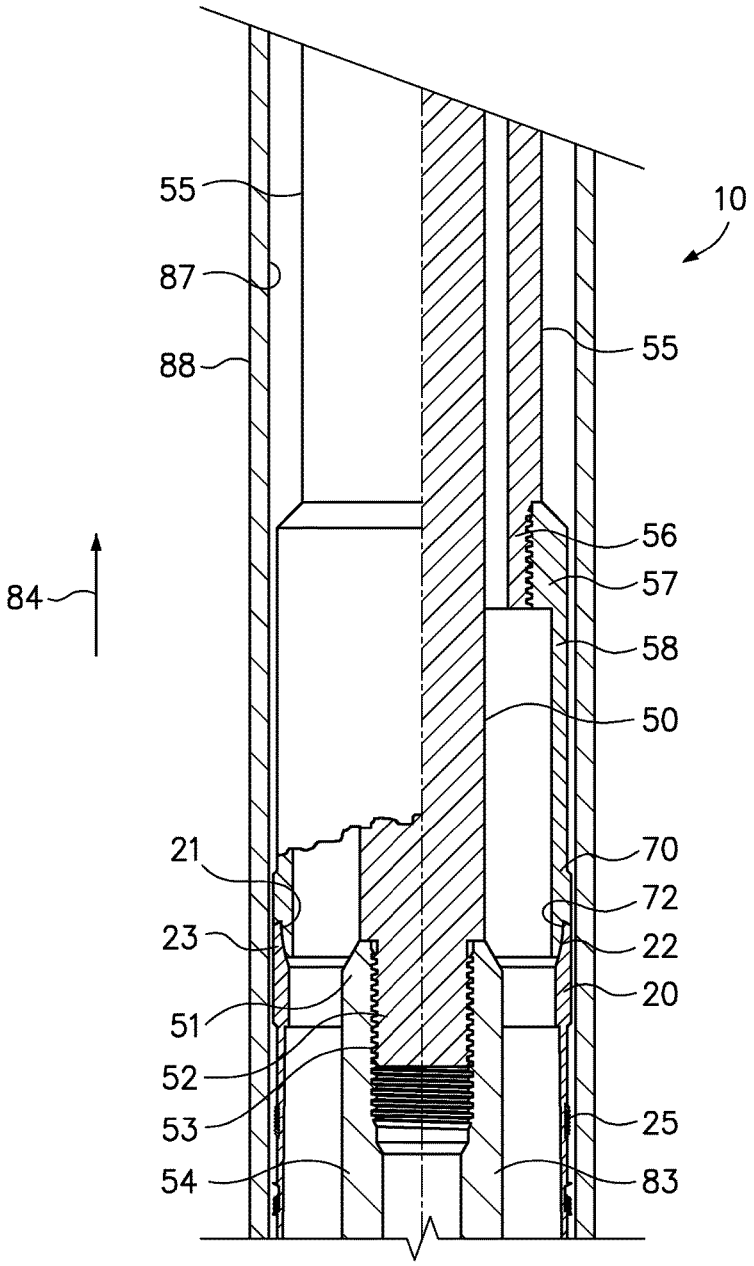
FIG. 5 is a partially sectioned elevation view of an upper portion of an embodiment of the ball seat installation apparatus of the present invention disposed within a well casing.

FIG. 5 is a partially sectioned elevation view of an upper portion of an embodiment of the hall seat installation apparatus 10 of the present invention disposed within a casing 88 having an interior wall 87. The apparatus 10 includes a housing 55 having a threaded portion 56 threadably connected to a threaded portion 57 of a reaction member 58. The reaction member 58 includes a distal end 70 having a downwardly-disposed notch or groove 72 to receive and cooperate with the dog or protrusion 23 on the proximal end 21 of the expandable ball seat 20. The reaction member 58 engages and reacts against the dog or protrusion 23 on the proximal end 21 of the expandable ball seat 20 during the expansion process to keep the expandable ball seat 20 stationary relative to the housing 55 of the apparatus 10.

FIG. 5 also includes an upper pulling mandrel 50 movably disposed within the housing 55. The upper pulling mandrel 50 includes a threaded portion 52 at a distal end 53 of the upper pulling mandrel 50 connected to a proximal end 51 of a lower pulling mandrel 83 that is a component of a pulling assembly 54 (more detail on the pulling assembly 54 provided on FIG. 6). It will be understood that the upper pulling mandrel 50, the lower pulling mandrel 83 and the pulling assembly 54, of which the lower pulling mandrel 83 is a part, can together be stroked to move relative to the housing 55 and in the direction of arrow 84 by activation of a motive member (not shown in FIG. 5) to be discussed in more detail below.

Figure 6:
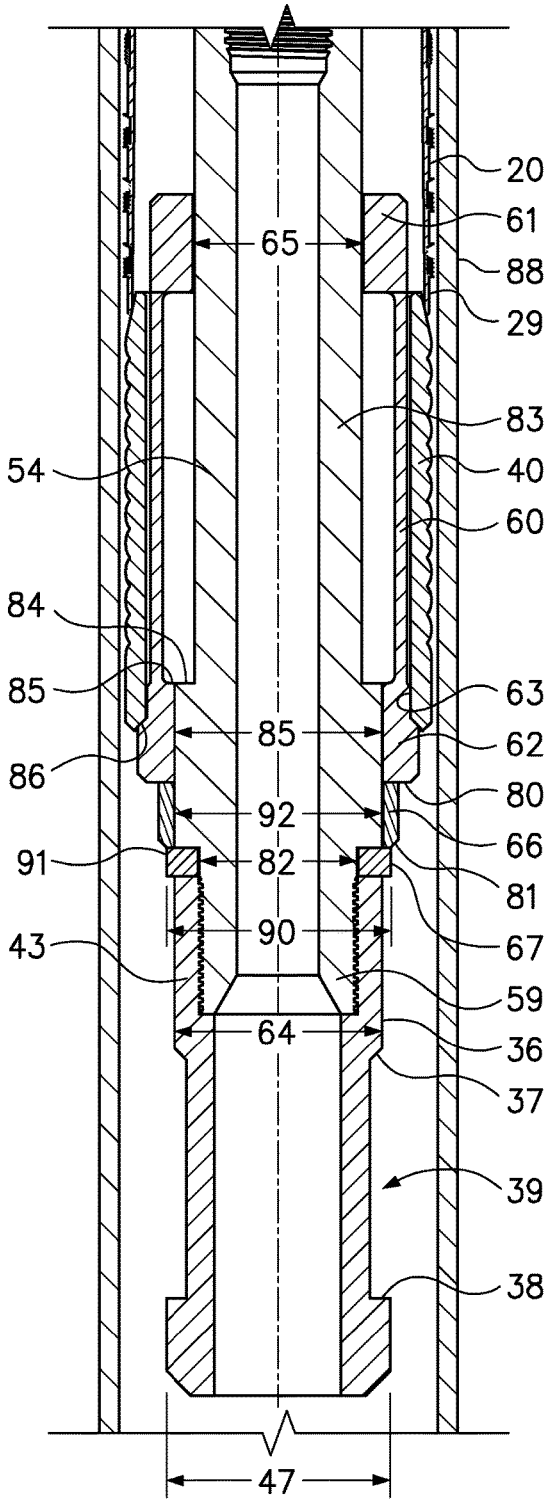
FIG. 6 is a sectional elevation view of a lower portion of the embodiment of the apparatus of FIG. 5. The pulling assembly is threadably connected at a distal end to a proximal end of a retainer.

FIG. 6 is a sectional elevation view of a lower portion of the apparatus 10 and illustrates the pulling assembly 54. The pulling assembly 54 includes the lower pulling mandrel 83 which is threadably connected at a distal end 59 to a proximal end 43 of a retainer 36. The retainer 36 includes a radially inwardly disposed channel 39 disposed axially intermediate a stop wall 38, having an outer diameter 47 that is smaller than the inner diameter 46 (see FIG. 2) of the expander 40, and a radially inwardly reducing transition 37 disposed on the retainer 36 intermediate the channel 39 and the proximal end 43 of the retainer 36. The outer diameter 64 of the proximal end 43 of the retainer 36 is smaller than the outer diameter 47 of the stop wall 38 of the retainer 36 and larger than the inner diameter 82 of a mechanical fuse 67 such as, for example, a shear ring.

Connecting the proximal end 43 of the retainer 36 to the distal end 59 of the lower pulling assembly mandrel 83 axially captures the mechanical fuse 67, a spacer 66, and a collet 60 on the lower pulling mandrel 83. The collet 60 includes a proximal, end 61 having an inner diameter 65 that is larger in diameter than the lower pulling, mandrel 83 and smaller in diameter than a stop wall 84 on the lower pulling mandrel 83. A distal end 62 of the collet 60 has an inner diameter 85 that is larger in diameter than the stop wall 84 on the lower pulling mandrel 83. The spacer 66 has an inner diameter 92 at least equal to that of the (un-collapsed) distal end 62 of the collet 60. The mechanical fuse 67 is axially captured intermediate the proximal end 43 of the retainer 36 and the spacer 66, and the mechanical fuse 67 and the spacer 66 are together axially captured intermediate the proximal end 43 of the retainer 36 and the distal end 62 of the collet 60. The mechanical fuse 67 has an outer diameter 90 that is larger than the inner diameter 92 of the spacer 66 and an inner diameter 82 that is smaller in diameter than the inner diameter 92 of the spacer 66. The mechanical fuse 67 is constructed to fail upon application of a predetermined load, applied from above by the spacer 66 to a radially outwardly annular portion of the mechanical fuse 67, as will be discussed in more detail below.

It will be understood by those skilled in the mechanical arts that once the expander 40 of FIG. 2 begins to enter and expand the sleeve portion 24 of the expandable ball seat 20 of FIG. the amount of force that must be applied to the distal end 49 of the expander 40 to force it further into the sleeve portion 24 of the expandable ball seat 20 will increase as the length of the circumferential overlap between the expander 40 and the expandable ball seat 20 increases. This relationship between the force required to advance the expander 40 results from the linearly increasing surface area of frictional engagement between the expander 40 and the expandable ball seat 20. The frictional resistance to advancement of the expander 40 into the expandable ball seat 20 is a function of, among other factors, the surface area over which the expander 40 is engaged with the expanded sleeve portion 24 of the expandable ball seat 20 in an interference fit. Theoretically, the amount of three necessary to advance the expander 40 further after one inch of circumferential overlap between the expander 40 and the expandable sleeve portion 24 of the expandable ball seat 20 will be one-half that required to advance the expander 40 further with two inches of circumferential overlap. The maximum amount of force required to advance the expander 40 into the expandable sleeve portion 24 of the expandable hall seat 20 will occur immediately prior to the expander 40 being advanced to its final position within the sleeve portion 24 of the expandable ball seat 20, and the mechanical fuse 67 is predisposed to fail at a load that is sufficient to ensure that the expander 40 is fully deployed into the expandable sleeve 20.

Figure 7A:
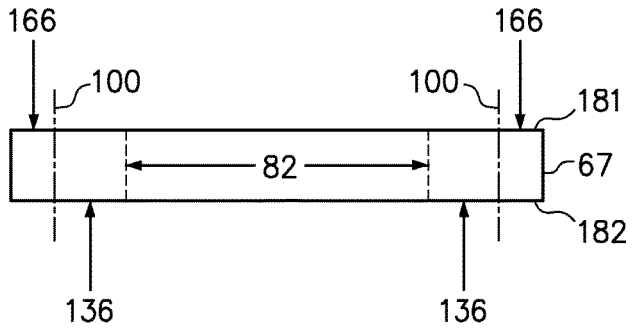
FIG. 7A is a free body diagram illustrating the forces applied to the mechanical fuse of FIG. 6 by the proximal end of the retainer, from below, and by the spacer, from above, upon actuation of a motive member to stroke the pulling mandrel of FIG. 6.

FIG. 7A is a free body diagram illustrating the forces applied to the mechanical fuse 67 by the proximal end 43 of the retainer 36 from below and by the spacer 66 from above. It will be understood that the portion of the lower pulling mandrel 54 that engages the mechanical fuse 67 will have no significant application of three to the mechanical fuse 67 compared to the dominant forces applied by the proximal end 43 of the retainer 36 and the spacer 66. FIG. 7A illustrates the mechanical fuse 67 being acted upon by forces from above and below, and radially outside the bore 82 of the mechanical fuse 67. The retainer 36 (not shown in FIG. 7A) imparts pressure to a distal face 82 on the bottom of the mechanical fuse 67 represented by the arrows 136. Similarly, the spacer 66 (not shown in FIG. 7A) imparts pressure to a proximal face 81 on the top of the mechanical fuse 67 represented by the arrows 166. It can be seen that the application of pressure (represented by arrows 166) by the spacer 66 to the proximal face 81 of the mechanical fuse 67 is to an outer annular area, and the application of pressure (represented by arrows 143) by the proximal end 43 of the retainer 36 to the distal face 82 of the mechanical fuse 67 is to an inner annular area that is axially and radially offset from the outer annular area. The result is that the mechanical fuse 67 is subjected to shear along a circular shear face 100 indicated by the dotted lines in FIG. 7A. When the shear stress imparted to the mechanical fuse 67 reaches a predetermined level, the mechanical fuse 67 fails, and the lower pulling mandrel 54 (see FIG. 6) is released to move without the expander 40 and, for a limited range of motion, without the collet 60 disposed within the bore 46 of the expander 40.

Figure 7B:
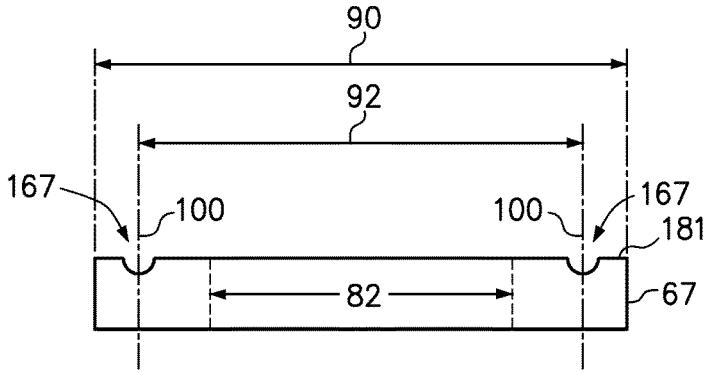
FIG. 7B is a sectional elevation view of a mechanical fuse having a circular groove disposed along, the shear face.

FIG. 7B is a sectional elevation view of an illustration of a mechanical fuse 67 that is predisposed to fail at a predetermined load by the inclusion of a circumferential groove 167 in the proximal face 81 of the mechanical fuse 67. The groove 167 may be formed with a depth that reduces the material thickness along the shear face 100.

Figure 7C:
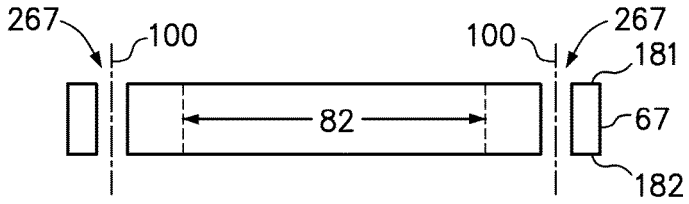
FIG. 7C is a sectional elevation view of a mechanical fuse having a plurality of equi-angularly distributed holes along the shear face.

FIG. 7C is a sectional elevation view of a mechanical fuse 67 that is predisposed to fail at a predetermined load by the inclusion of a plurality of holes 267 drilled from the proximal face 81 of the mechanical fuse 67 through to the distal face 82. The holes 267 may be angularly distributed about the bore 82 that reduces the net effective material thickness along the shear face 100 created by the opposing pressures represented in FIG. 7A by the arrows 166 and 143.

Figure 8:
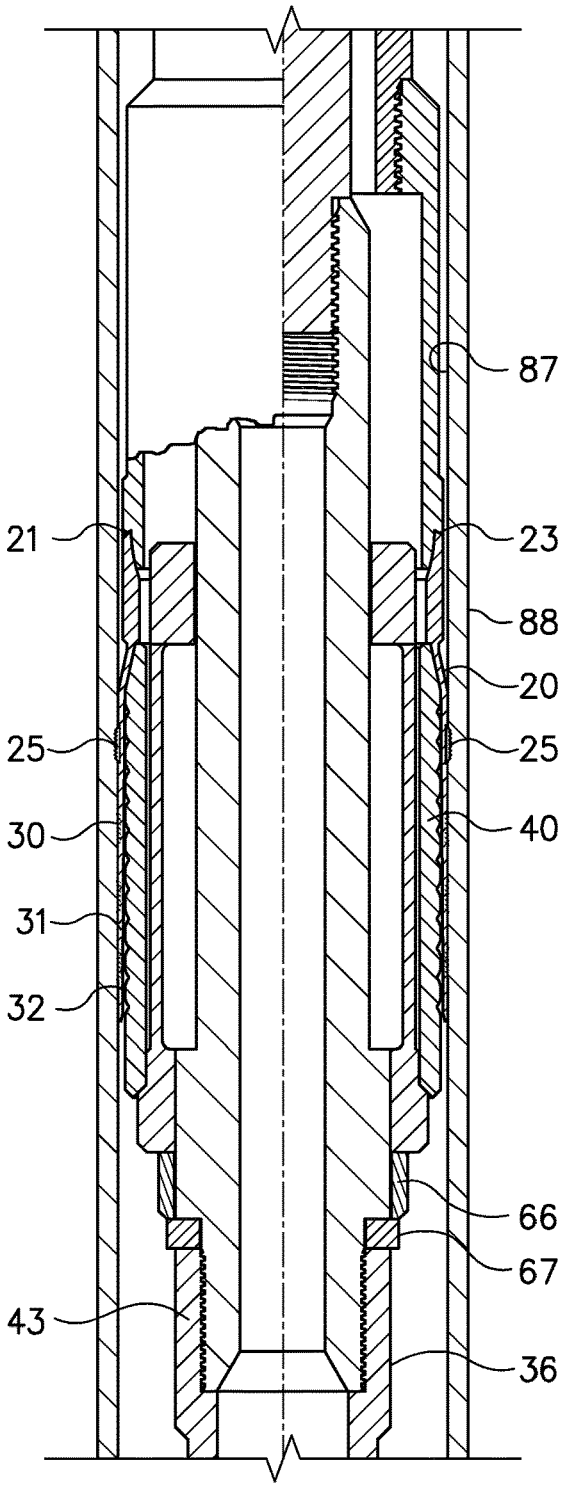
FIG. 8 is a sectional elevation view of the lower portion of the embodiment of the apparatus of FIG. 6 after the motive member is partially stroked to urge the retainer against the mechanical fuse and the spacer to displace the collet and the expander secured thereto into the expandable ball seat to engage the at least one gripping element and the at least one sealing element with the well casing.

FIG. 8 is a sectional elevation view of the lower portion of the embodiment of the apparatus of FIG. 6 after the motive member (not shown) is partially stroked to urge the proximal end 43 of the retainer 36 against the mechanical fuse 67 and the spacer 66 that engages the mechanical fuse 67 to displace the collet 60 and the expander 40 engaged by the collet 60 and axially movable with the collet 60 into the expandable ball seat 20 until the proximal end 41 of the expander 40 engages a radially thicker proximal end 21 of the expandable ball seat 20. The expansion of the expandable sleeve portion 24 of the expandable hall and seat 20 engages the at least one gripping element 25 and the at least one sealing element 26, 27, 28, 31 and 32 with the interior wall 87 of the well casing 88.

Figure 9:
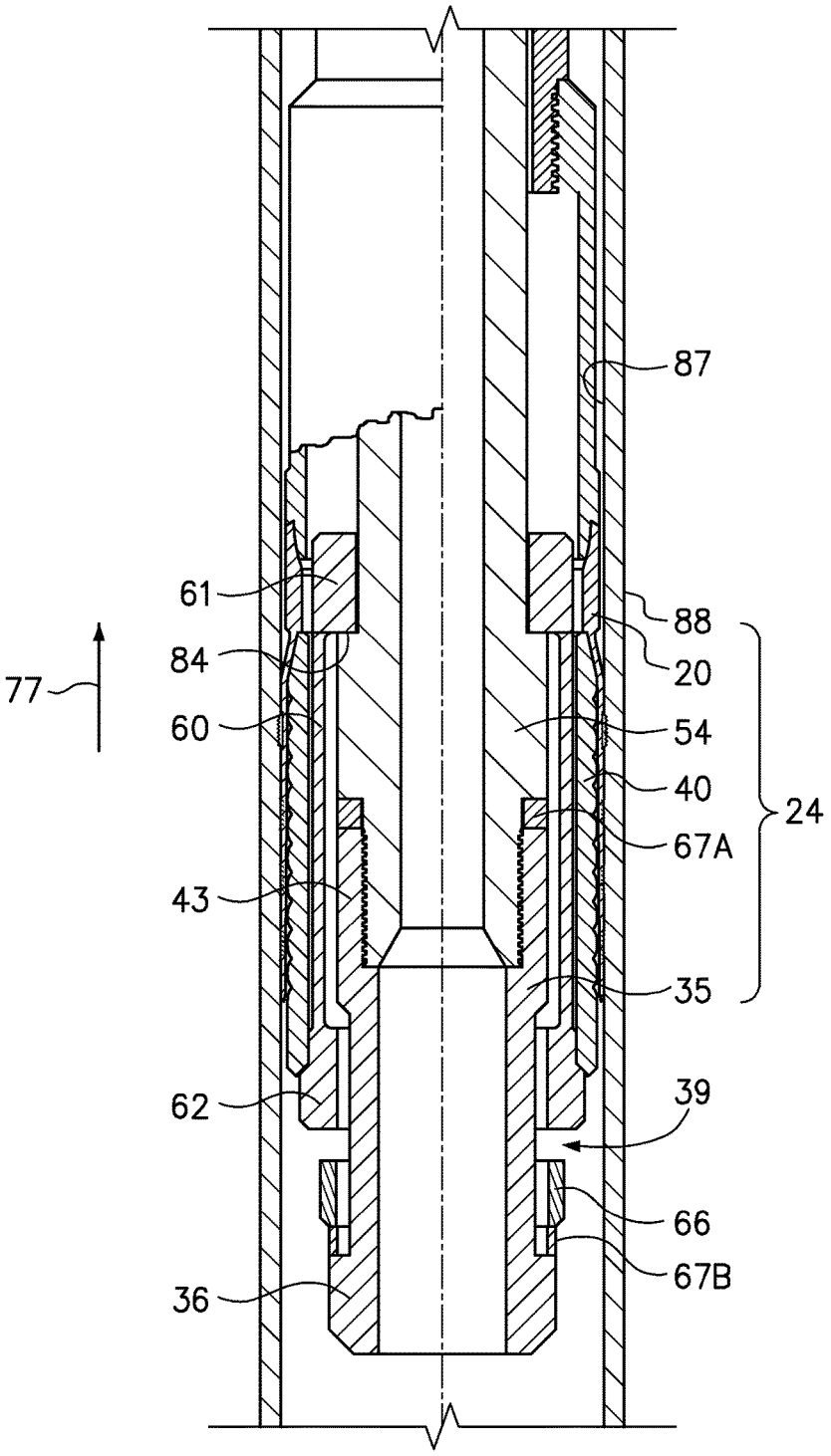
FIG. 9 is the sectional elevation view of FIG. 8 after the sacrificial failure of the shear ring. The sheared portion of the mechanical fuse, the spacer and the collet are no longer supported by the retainer, and the remaining portion of the mechanical fuse moves through the collet and the expander with the lower pulling mandrel and the retainer.

FIG. 9 is a sectional elevation view of the expander 40 after being pulled by the upper pulling mandrel 50, the lower pulling mandrel 54 and the retainer 36, which acts upon the mechanical fuse 67 and the spacer 66, to the full insertion position within the expanded sleeve portion 24 of the expandable ball seat 20. It will be understood that the mechanical fuse 67 is adapted to fail at an application of three that coincides with this fully inserted position of the expander 40. The sealing elements 27 and 28 on the exterior surface 34 of the expandable ball seat 20 that penetratively engage the interior wall 87 of the casing 88 are now disposed in engagement with the interior wall 87 of the casing 88. Also, the elastomeric sealing elements 30, 31 and 32 that are disposed on the exterior surface 34 of the expandable sleeve portion 24 of the expandable ball and seat 20 are substantially deformed by the force imparted to the sealing elements 30, 31 and 32 by the expander 40 engaging the expandable sleeve 20 to provide an interference fit that sandwiches the expandable sleeve portion 24 of the expandable ball and seat 20 between the expander 40 and the interior wall 87 of the casing 88. The sheared portion 67B of the mechanical fuse 67, the spacer 66 and the collet 60 are no longer supported by the proximal end 43 of the retainer 36, and the captured and remaining portion of the mechanical fuse 67A moves through the collet 60 and the expander 40 thereon with the lower pulling mandrel 54 and the retainer 36 until the proximal end 61 of the collet 60 engages the stop wall 84 on the lower pulling mandrel 54. It will be observed in FIG. 9 that the sheared portion 67B of the mechanical fuse 67 and the spacer 66 have dropped to the channel 39 on the retainer 36. It will be understood that once the proximal end 61 of the collet 60 engages the stop wall 84 on the lower pulling mandrel 54, further upward movement of the lower pulling mandrel 54 will pull the collet 60 along with it, thereby removing it from the expander 40.

Figure 10:
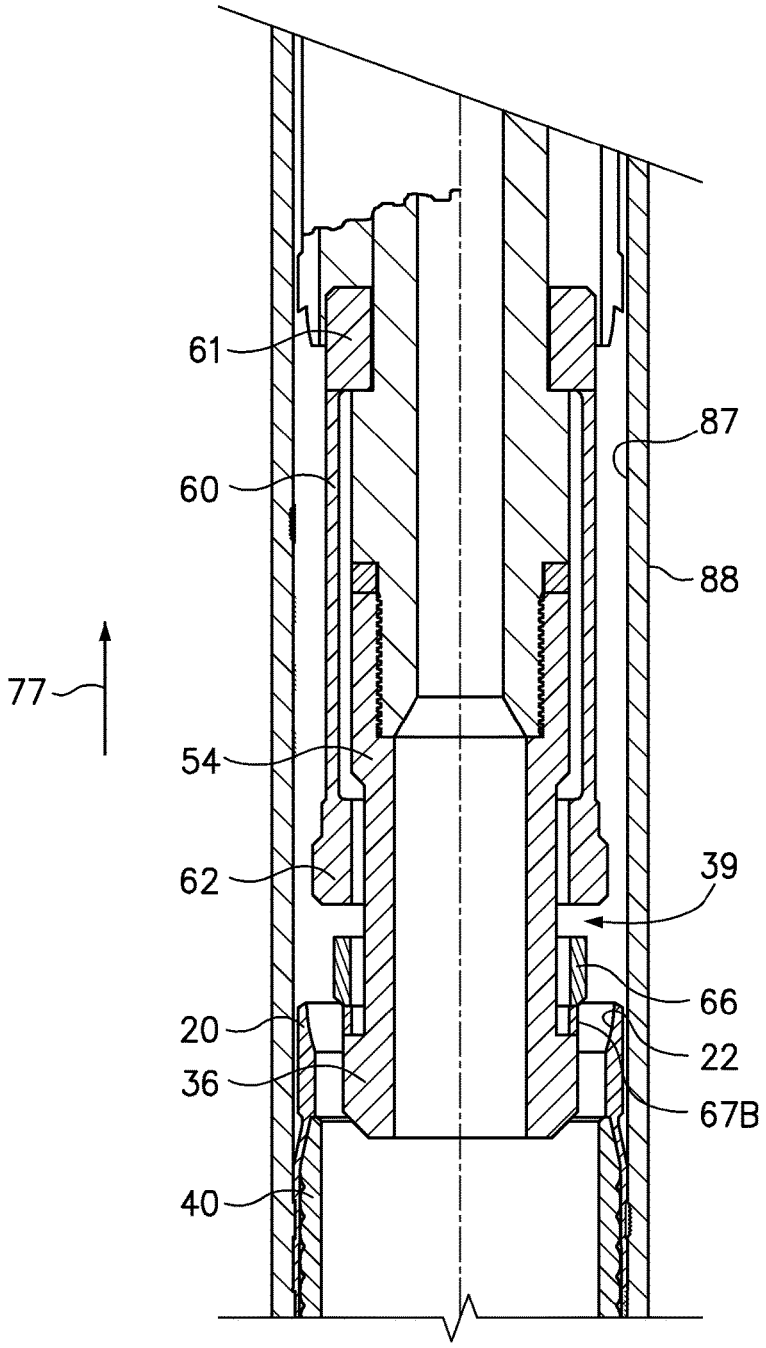
FIG. 10 is the sectional view of FIG. 9 after the lower pulling mandrel and the retainer move to radially align the bore of the distal end of the collet with the channel on the retainer to enable collapse of the distal end of the collet into the channel to enable the distal end of the collet to pass through the expander.

FIG. 10 is a view of the lower portion of the apparatus 10 after the mechanical fuse 67 fails and the upper pulling mandrel 50, the lower pulling mandrel 54, the retainer 36 and the collet 60 are all moved upwardly relative to the housing 55 (not shown) and the expander 40, which is lodged along with the expanded ball seat 20 in the well casing 88 in an interference fit. FIG. 10 is the sectional view of FIG. 9 after the lower pulling mandrel 54, the retainer 36 and the channel 39 on the retainer 36 move in the direction of arrow 77 to radially align the bore 85 of the distal end 62 of the collet 60 with the channel 39 on the retainer 36 to enable collapse of the distal end 62 of the collet 60 into the channel 39 to thereby enable the notch, catcher or keeper 63 on the distal end 62 of the collet 60 to collapse radially inwardly and to enable the collapsed distal end 62 of the collet 60 to pass through the expander 40.

Figure 11:
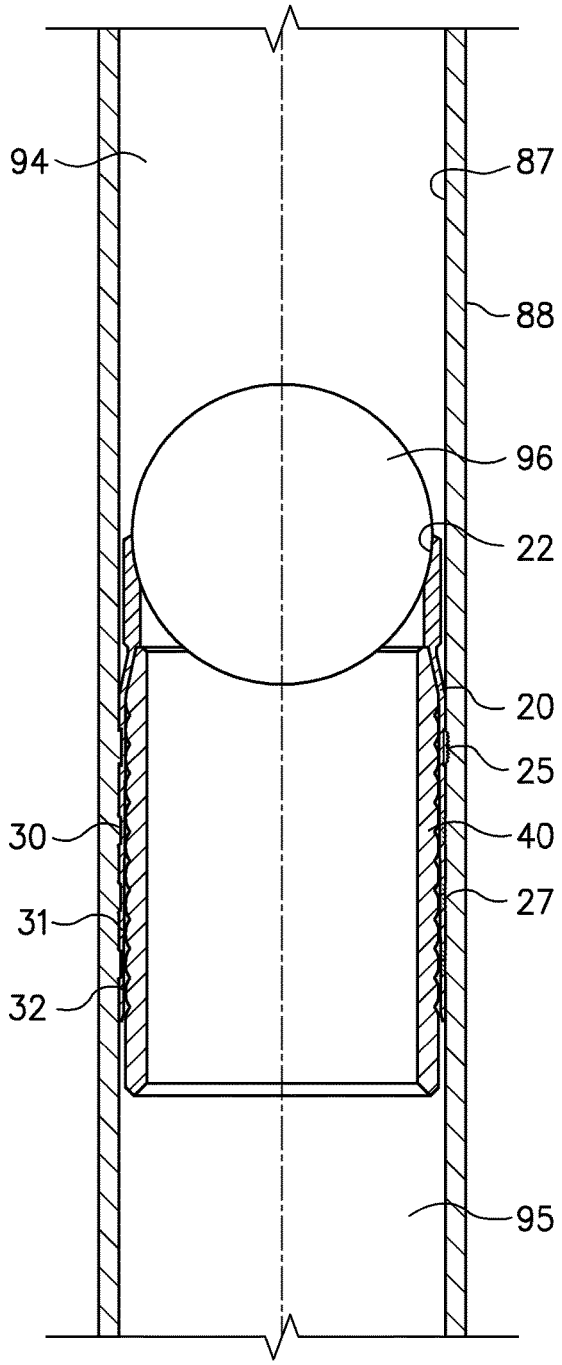
FIG. 11 is a sectional elevation view of an expanded ball seat installed in a casing with a ball sealably received into the ball seat of the expanded ball seat to isolate a proximal portion of the bore of the well casing from the distal portion of the bore of the well casing.

FIG. 11 is a sectional elevation view of an expanded ball seat 20 installed in a casing 88 and sandwiched between the expander 40 and the interior wall 87 of the casing 88, A dissolvable ball 96 is sealably received into the ball seat 22 of the expanded ball seat 20 to isolate a proximal portion 94 of the well casing 88 from the distal portion 95 of the well casing 88. The hall 96 may, in one embodiment of the present invention, be a dissolvable ball that dissolves as a result of prolonged contact with drilling or walkover fluids that reside in the well casing 88 during the fracturing operation. For example, but not by way of limitation, a dissolvable ball 96 may be obtained from Magnum Oil Tools International of Corpus Christi, Tex., USA. More specifically, the hall 96 may be a Magnum Fastball™ model of dissolvable ball that is available from Magnum Oil Tools international. It will be understood that other balls, including other dissolvable balls, may be used to engage and seal with the expanded ball seat 20 installed in the well casing 88 using the present invention.

It will be understood that the apparatus ID of the present invention includes a large diameter ball seat 22 that permits tools to be passed through the ball seat 22 to perform work at depths beyond the installed location of the ball seat 22 in the well casing 88. It will be understood that this advantageous feature prevents well obstruction and prevents the need for removing the ball seat 22 from the well casing 88 for subsequent well operations.

The apparatus of the present invention may be used for staged fracturing of a geologic formation by coupling the apparatus to a distal end of a positioning member such as, for example, a tubular string made up of threadably connected pipe joints, a tubular string made up of a coiled and continuous string of tubing, or a wire line that includes an electrical conductor. The apparatus can be run into a well casing and positioned within the well casing at a predetermined and targeted depth using the positioning member. The apparatus can be activated through the positioning member to expand the expandable sleeve portion of the ball seat assembly to engage the well casing at a predetermined depth. The positioning member and the apparatus are removed from the well. A ball, preferably a dissolving ball, is introduced into the well and pumped to engage the ball seat. The pressure of fluid trapped between the ball seat with the ball and the surface can be increased to fracture the geologic formation adjacent to the pressurized portion of the well casing after perforating the casing. The dissolvable ball is left engaged with the ball seat at the apparatus.

The apparatus is "reloaded" at the surface with an unexpanded ball seat assembly and expander. The reloaded apparatus is then run back into the well casing, to a new depth that is spaced apart from and shallower than the depth at which the first expandable ball seat is installed. The second ball seat is installed and the apparatus is removed from the well casing. A second dissolvable ball is introduced after perforating casing and pumped to engage the second ball seat, and this process is repeated until the desired number of stages of fracturing is completed. It will be understood that each time the dissolvable ball is left intact with the ball seat in which it is engaged, and each ball will dissolve to clear the well of obstructions.

The words "proximal" and "distal," as used herein, means in an uphole direction towards the surface end of the well and in a downhole direction towards the "rat hole" or opposite terminus of the well. When used in reference to a component of the apparatus, "proximal" means the end of the component disposed towards the surface end of the well and "distal" means the end of the component disposed towards the rat hole or terminus of the well.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An apparatus for being run into a well casing at a distal end of an elongate positioning member for installing an expandable ball seat in the well casing, the apparatus comprising:

a tubular housing having a proximal end connected to the positioning member, a distal end and a bore;

a pulling mandrel movably disposed within the bore of the housing and having a proximal end and a connector at a distal end, the pulling mandrel movable from an extended position to a retracted position relative to the housing;

a motive member coupled intermediate, the housing and the pulling mandrel, the motive member being activatable, through the positioning, member, to move the pulling mandrel from the extended position to the retracted position;

a ball seat assembly having a bore with an inner diameter to receive the pulling mandrel, a ball seat at a proximal end, an expandable sleeve, portion that includes a distal end of the ball seat assembly, at least one circumferential sealing element disposed on a radially exterior surface of the expandable sleeve portion, and at least one gripping element disposed within a channel on the exterior surface of the expandable sleeve portion;

a tubular expander having a bore, an inwardly tapered exterior portion at a proximal end engaging the distal end of the expandable sleeve portion of the ball seat assembly, a distal end, and an outer diameter that is larger than the inner diameter of the expandable sleeve portion of the ball seat assembly;

a collet removably received within the bore of the expander and having a proximal end with a first bore, a distal end with a second bore that is radially inwardly collapsible, a radially inwardly disposed channel intermediate the first bore and the second bore, and a notch on a radially exterior portion of the collet to engage the distal end of the expander for displacing the expander towards the housing and into the bore of the ball seat assembly;

a spacer having a bore to receive the pulling mandrel, a proximal end to engage the distal end of the collet, and a distal end;

a mechanical fuse having a bore with an inner diameter, an outer diameter, a proximal face to engage the spacer, and a distal end; and a retainer having a bore, a proximal end with a connector connected to the connector on the distal end of the pulling member to secure the mechanical fuse between the retainer, engaging the distal face of the mechanical fuse, and the pulling mandrel, engaging the proximal face of the mechanical fuse, the retainer further including an outer diameter at the proximal end of the retainer being greater than the inner diameter of the bore of the mechanical fuse element and less than the outer diameter of the mechanical fuse element, a distal end with an outer diameter greater than the outer diameter at the proximal end of the retainer, and a radially inwardly disposed channel intermediate the proximal end and the distal end of the retainer, the channel having an axial span that is greater than an axial span of the second, collapsible bore of the collet:

wherein upon activation of the motive member to move the pulling mandrel from the extended position to the retracted position, the retainer applies pressure to an inner annular distal face of the mechanical fuse element to produce a reaction force applied by the spacer engages to an outer annular proximal face of the mechanical fuse element that is radially offset from the inner annular distal face and to move the pulling mandrel, the retainer, the mechanical fuse, the spacer, the collet, engaged at the distal end by the spacer, and the expander, axially engaged by the collet at the notch on a radially exterior portion of the collet, towards the housing to pull the expander into the bore of the expandable sleeve portion of the ball seat assembly;

wherein upon application by the spacer of a reaction force against the outer annular proximal face of the mechanical fuse of pressure sufficient to shear the mechanical fuse along a shear face intermediate the outer annular proximal face and the inner annular distal face of the mechanical fuse, the mechanical fuse sacrificially fails along the shear face to separate a sheared portion of the mechanical fuse from a remaining portion of the mechanical fuse;

wherein after failure of the mechanical fuse, the pulling mandrel, the retainer and the remaining portion of the mechanical fuse move by the activated motive member through an interval towards the retracted position of the pulling mandrel engages the proximal end of the collet with a stop wall on the pulling, mandrel to prevent further movement of the pulling mandrel without movement of the collet, and also disposes the distal end of the collet radially adjacent to the channel of the retainer;

wherein further movement of the pulling mandrel, the retainer and the remaining portion of the mechanical fuse by the activated motive member towards the retracted position of the pulling mandrel collapses the second bore at the distal end of the collet into the channel of the retainer to enable the collet to move with the pulling mandrel from the bore of the expander, leaving the expander in an interference fit with the well casing with the expanded sleeve portion of the ball seat assembly sandwiched therebetween and with the ball seat of the ball seat assembly positioned adjacent to the expander and expanded sleeve portion of the ball seat assembly to receive and seal with a ball; and wherein the positioning member is used to remove the apparatus, less the expander and the ball seat assembly, from the casing.

2. The apparatus of claim 1, wherein the at least one gripping element of the ball seat assembly includes at least one slip member having gripping teeth on a radially outwardly disposed surface, the at least one gripping element being slidably received into an open end of the at least one dovetailed groove formed on an exterior surface of the sleeve portion of the ball seat assembly; and wherein the at least one groove extends along a portion of the exterior surface of the sleeve portion of the ball seat assembly and perpendicularly to an axis of the sleeve portion.

3. The apparatus of claim 2, wherein the at least one circumferential sealing element of the ball seat assembly includes one or more radially outwardly extending circumferential ridges.

4. The apparatus of claim 3, wherein the at least one circumferential sealing element of the ball seat assembly includes a plurality of radially outwardly extending circumferential ridges, each spaced from the others, and further includes at least one deformable elastomeric sealing element having an original thickness and width, the at least one elastomeric sealing element having an original thickness and width, the at least one elastomeric sealing element circumferentially disposed on the exterior surface of the expandable sleeve portion of the ball seat assembly and intermediate a first radially outwardly extending circumferential ridge and a second radially outwardly extending circumferential ridge.

5. The apparatus of claim 1, wherein the elongate positioning member is a tubular string including, a plurality of pipe segments connected in series and a distal end connected to the apparatus; and wherein the motive member is a hydraulically powered displacement device responsive to a predetermined hydraulic pressure provided to the apparatus through a bore of the tubular string.

6. The apparatus of claim 1, wherein the elongate positioning member is a wireline including an electrically conductive cable; and wherein the motive member includes an electrically powered pump provided to pump liquid into a hydraulically powered displacement device.

7. The apparatus of claim 1, wherein the elongate positioning member is a coiled tubing unit.

8. The apparatus of claim 1, wherein the sacrificially failing mechanical fuse comprises one of a metal member having, a circular groove therein and a metal member having, a plurality of holes equi-angularly distributed therein.

9. The apparatus of claim 1, wherein the connector at the distal end of the pulling mandrel and the connector at the proximal end of the retainer are threaded connectors.

10. The apparatus of claim 1, wherein the pulling mandrel and the retainer together comprise a central bore through which fluid may pass as the apparatus is run into the well casing to a targeted interval.

11. The apparatus of claim 1, wherein the sheared portion of the mechanical fuse and the spacer are retained on an enlarged distal portion of the retainer for removal from the well casing.

12. A ball seat apparatus for use in fracturing a geologic formation adjacent to a well casing in which the ball seat is installed, the ball seat comprising:

a ball seat assembly having a bore with an inner diameter, a ball seat supported at a proximal end of the ball seat assembly, an expanded sleeve portion that includes a distal end of the ball seat assembly, at least one circumferential sealing element disposed on a radially exterior surface of the expanded sleeve portion, and at least one gripping element disposed within a channel on the exterior surface of the expanded sleeve portion, wherein a distal end of the ball seat is directly attached to a proximal end of the expanded sleeve portion, wherein the ball seat comprises a radial wall thickness that is larger than a radial wall thickness of the expanded sleeve portion; and an expander having a bore, a proximal end positioned within the bore of the ball seat assembly intermediate the distal end of the ball seat assembly and the ball seat, a distal end, an inner diameter and an exterior surface with an outer diameter engaged with the inner diameter of the ball seat assembly;

wherein the expanded sleeve portion of the ball seat assembly is radially captured in an interference fit between the exterior surface of the expander and an interior wall of the well casing.

13. The ball seat apparatus of claim 12, wherein the at least one circumferential sealing element of the ball seat assembly includes a radially outwardly extending circumferential ridge.

14. The ball seat apparatus of claim 13, wherein the at least one circumferential sealing element of the ball seat assembly includes a plurality of radially outwardly extending circumferential ridges, each spaced from the others.

15. The ball seat apparatus of claim 14, wherein the at least one circumferential sealing element of the ball seat further includes one or more deformable elastomeric sealing elements each having an original thickness and width, wherein each elastomeric sealing element is circumferentially disposed on the exterior surface of the expanded sleeve portion of the ball seat assembly and intermediate a first radially outwardly extending circumferential ridge and a second radially outwardly extending circumferential ridge.

16. The ball seat apparatus of claim 12, wherein the at least one gripping element comprises a slip slidably received into a dovetailed groove formed in the radially exterior surface.

17. The ball seat apparatus of claim 16, wherein the dovetailed groove is formed on the exterior surface perpendicularly to an axis of the bore of the ball seat assembly.

18. The ball seat apparatus of claim 12, wherein a proximal end of an exterior surface of the expander is engaged with the distal end of the ball seat.

19. The ball seat apparatus of claim 18, wherein the expander comprises an inwardly tapered portion at the proximal end of the exterior surface of the expander, wherein the inwardly tapered portion is engaged with the distal end of the ball seat.

20. The ball seat apparatus of claim 12, wherein the exterior surface of the expander is engaged with the inner diameter of the ball seat assembly along an entire length of the expanded sleeve portion from the ball seat to the distal end of the ball seat assembly.

21. The ball seat apparatus of claim 12, wherein a bore through the ball seat and the bore of the expander are each sized to allow well tools to be passed therethrough.

* * * * *